United States Patent [19]

Forterre et al.

[11] 4,186,357

[45] Jan. 29, 1980

[54] NON-RECIPROCAL MICROWAVE PHASE SHIFTERS OPERATING IN A WIDE BAND ON EDGE MODE

[75] Inventors: Gérard Forterre; Jean Marcoux, both of Paris, France

[73] Assignee: Societe Lignes Telegraphiques et Telephoniques, Paris, France

[21] Appl. No.: 884,731

[22] Filed: Mar. 9, 1978

[30] Foreign Application Priority Data

Mar. 18, 1977 [FR] France ..... 77 08176

[51] Int. Cl.[2] ..... H01P 1/40

[52] U.S. Cl. ..... 333/24.1; 33/251

[58] Field of Search ..... 333/24.1, 24.2

[56] References Cited

U.S. PATENT DOCUMENTS 3,845,413 10/1974 Chiron et al. ..... 333/24.1 X

FOREIGN PATENT DOCUMENTS 2710506 9/1977 Fed. Rep. of Germany ..... 333/24.2

*Primary Examiner*—Paul L. Gensler

*Attorney, Agent, or Firm*—Kemon & Estabrook

[57] ABSTRACT

A stripline non-reciprocal multi-octave phase shifter which consists of a matched dielectric slab located along the first ferrite slab edge which corresponds to the magnetic wall and of lumped loads placed along the propagation direction along the same edge of the second ferrite slab. The other edge of the slabs are associated with identical composite media terminated by a lump impedance which consists of a short-circuit between the three conductors in the preferred embodiment of the invention. A high permittivity dielectric slab near the other edge of each of the ferrite slabs is preferably part of said composite media.

5 Claims, 13 Drawing Figures

NON-RECIPROCAL MICROWAVE PHASE SHIFTERS OPERATING IN A WIDE BAND ON EDGE MODE

BACKGROUND OF THE INVENTION

The present invention concerns an improved non-reciprocal phase shifter structure having a wide band (more than 2 octaves) which operates in the microwave band (1 GHz to several tens of GHz) based on a propagation according to a non-reciprocal surface mode.

Recent theoretical studies on propagation modes for electromagnetic energy in a slab of gyromagnetic material, such as the article published in the review "Cables et Transmission" (Octobre 1973, pages 416–435) by Messrs COURTOIS, CHIRON and FORTERRE, have shown the existence of two TE modes designated respectively by the terms magnetostatic mode and dynamic mode, the latter often being referred to as "edge mode" in the literature. The dynamic mode exhibits the characteristic of a theoretically infinite bandwidth and a non-reciprocal character, which are utilized in the phase shifters of the invention. Referring to the notations of FIG. 1 which illustrates a slab of gyromagnetic material associated with a trirectangular reference O, x, y, z, subjected to a magnetizing field $H_o$ along Oz, in which the energy is propagated along Oy, the dimension of the slab in this direction being assumed to be infinite, the dynamic $TE_{oo}$ mode is characterized by the following conditions:

| Electric field | Magnetic field |
|---|---|
| $E_x = O$ | $H_x = A \cdot \dfrac{K_y - j\frac{K}{\mu}k_x}{\mu_{eff}}$ |
| $E_y = O$ | $H_y = A \cdot \dfrac{K_x + j\frac{K}{\mu}k_x}{\mu_{eff}}$ |
| $E_z = A$ | $H_z = O$ |

where

A is a constant $k_x$ and $k_y$ are the wave numbers $=2\pi/\lambda$

K and $\mu$ are the components of the permeability tensor $\mu_{eff}$ is the effective permeability of the material.

The energy in this mode is concentrated along one edge or the other of the ferrite slab in the direction of propagation.

The present invention consists of means intended to modify the conditions at the limits of the volume in which the energy is propagated, so as to obtain a differential phase shift which remains constant in a frequency band larger than 2 octaves.

It is well known (see in this connection the aforesaid article and the article published in Transactions of the MTT Group of the Institute of the Electrical and Electronic Engineers issued of May 5th, 1971, by M. E. Hines) to establish "a magnetic wall" on one of the sides of the central conductor.

PRIOR ART

There has been described with reference to FIG. 28 of U.S. Pat. No. 3,845,413 a surface wave (or edge wave) non-reciprocal phase shifter structure whose characteristic is illustrated in FIG. 29 of the same patent. This structure comprises essentially a conductive ground plane, on which there rest a dielectric slab and a ferrite slab which are disposed in contact with one another, the plane of contact of the two slabs containing the direction of propagation and that of the magnetising field. A plane conductor disposed on the slab is covered by two wafers identical to the preceding ones, the two ferrite wafers being superimposed. The present invention has for its object to provide an improved phase shifter having a constant differential phase shift in a band greater than 2 octaves, which is not the case in the constructions according to the aforesaid patent.

There have been described in U.S. Pat. No. 3,978,433 filed on the May 6, 1975 structures of the isolator or circulator type which utilise a surface mode propagation, wherein one of the edges of the ferrite slab is in contact with an electrical short-circuit established between the central conductor and the external conductors at least over a part of its length. Such structures have a frequency band which is much less than 1 octave and a detailed study of their operating conditions shows that they utilise a propagation according to a magnetostatic mode and not a dynamic mode as in the present invention. They utilise the difference of the attenuations between the two directions of propagation and not the difference in the phase shifts.

The phase shifters according to the invention exhibit, as compared with the phase shifters of the prior art, an increased bandwidth, since they cover a 3 octave band for a phase shift of 90°±20° and an insertion loss varying between 0.5 dB and 1.5 dB for bandwidths ranging from 1.5 to 3 octaves.

SUMMARY OF THE INVENTION

The devices according to the present invention are produced by stripline technology in which surface wave energy is propagated in the neighbourhood of an edge of a central plane conductor disposed symmetrically between two external conductors defining two propagation volumes bounded respectively by the central conductor and each of the external conductors. It is customary to use identical propagation volumes, that is to say, to dispose the same stacked elements on either side of the central conductor, i.e. slabs of gyromagnetic material and/or of dielectric material.

On the contrary, the present invention consists in means which, while maintaining the magnetic wall condition, effect a differential phase shift which differs in accordance with the way of propagation and which maintains the monomode propagation in accordance with the $TE_{oo}$ surface mode in the operating bandwidth. The characteristic means of the invention consist in:

(1) first means located on the magnetic wall side which promote the propagation of the parasitic modes outside the volume in which the $TE_{oo}$ mode is propagated, and means for absorbing them (2) second means located on the opposite side which establish a non-reciprocity with the aid of a complex propagation medium associated in some constructions with a lump impedance.

The first means consist in disposing in a first volume in which is located the first gyromagnetic slab a dielectric medium whose permittivity is equal to that of the gyromagnetic medium and which is so dimensioned as to make propagation of the parasitic volume modes easy and in disposing in the second volume in proximity to the second gyromagnetic slab localized loads which are intended to absorb the energy of the parasitic modes propagated in the dielectric medium. It is to be noted that the structure thus formed is not symmetrical about the plane of the central conductor.

The second means consists in disposing on the side of the gyromagnetic slab opposite to the magnetic wall at least one medium whose electrical properties are different from those for propagating the edge mode. This medium may be a second gyromagnetic material having higher saturation induction and/or a dielectric medium and in some cases a lump impedance.

In the preferred variant of the invention, these second means consist in a dielectric medium having high permittivity as compared with that of the gyromagnetic medium, associated with lumped loads, and a short-circuit between the central conductor and the two external conductors, disposed at some distance from the closer edge of the ferrite slab.

BRIEF DESCRIPTION OF THE FIGURES

The invention wll be readily understood from the following description of various embodiments of the invention and by reference to the accompanying figures in which.

DETAILED DISCLOSURE

Figure 1:
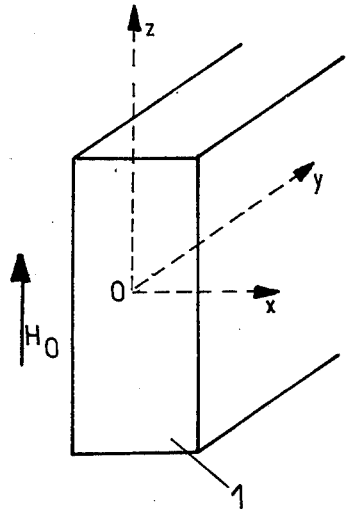
FIG. 1 defines a reference.

FIG. 1 is essentially intended to define the various directions with respect to the ferrite slab 1. The surface waves propagate along OY, the magnetizing magnetic field is parallel to OZ. The different slabs are disposed side by side, their adjacent face being parallel to the plane YOZ. The conductor planes are disposed parallel to XOY.

Figure 2:
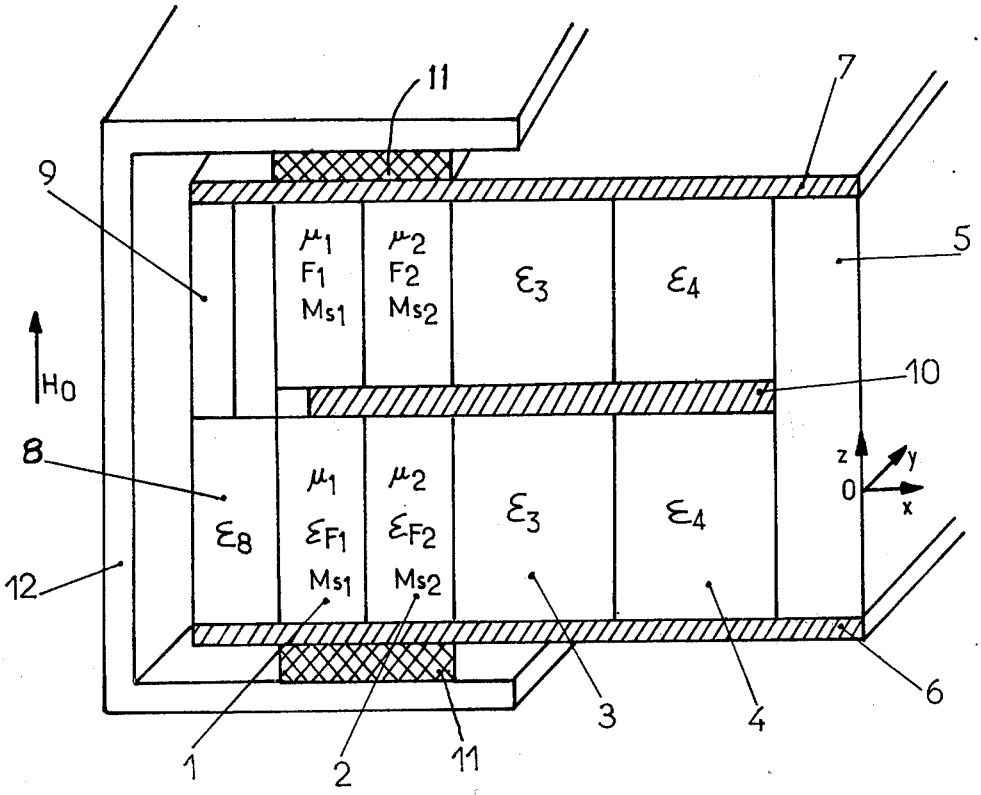
FIG. 2 is a sectional view of a complex phase shifter structure according to the invention.

FIG. 2 is a view of a phase shifter structure according to the invention in section cut along a plane parallel to XOZ. The central conductor is shown at 10. Each half-structure, disposed on either side of the central conductor 10, comprises the juxtaposition of the following slabs:

a slab 1 of gyromagnetic material having a permittivity $\epsilon_{F1}$ a second slab 2 of gyromagnetic material having a permittivity $\epsilon_{F2}$ a slab 3 of dielectric material having a permittivity $\epsilon_3$ a second slab 4 of dielectric material having a permittivity $\epsilon_4$ an impedance 5 connecting the two external conductors 6 and 7 of the strip structure to the central conductor 10. The various elements disposed starting from the slab of gyromagnetic material 1 have been enumerated in the positive sense of the axis OX of FIG. 1. The symmetry is broken on examination of the structure established in the negative direction of the axis OX starting from the slab 1. The lower portion of the structure comprises a dielectric slab 8 having permittivity $\epsilon_8$, which is intended to ensure continuity of a propagation medium for the volume modes, that is to say, $\epsilon_8=\epsilon_{F1}$ if $\epsilon_{F1}$ is the permittivity of the adjacent gyromagnetic material. The upper portion comprises a set of lumped loads 9 disposed at appropriate distances from the external face of the slab 1 of gyromagnetic material and located along axis OY at points chosen to ensure effective absorption of the parasitic volume modes which are developed in the structure in the operating bandwidth. There is described in detail in the U.S. patent application Ser. No. 928,273 filed on July 26, 1978, for: "Wide band microwave isolators", the manner in which the lump loads 9 are disposed along the structure of the isolator in the forward direction of propagation of the waves. The same parameters fix the positioning of the loads 9 in the phase shifter. As will be apparent, the central conductor 10 extends over the assembly comprising the slabs 1, 2, 3, 4 as far as the impedance 5. It is interrupted within medium 1 so as to obtain the well known magnetic wall effect on this side. The various values of the parameters of the elements constituting the structure of FIG. 2, i.e. the permittivities and the geometrical dimensions are chosen as explained with reference to the examples of simplified structures which are given in the following. However, the following conditions must be met:

$$\mu_1=\mu_2=1 \text{ (the two media are saturated)}$$

$$\epsilon_{F1}=\epsilon_8$$

$$4\pi M_{S1}<4\pi M_{S2},$$

where $M_S$=saturation induction of the gyromagnetic medium $$1<\epsilon_4\leq\epsilon_{F1}$$

Two permanent magnets are shown at 11 which establish a magnetizing field $H_o$ along OZ through the slabs of gyromagnetic material. This field is at least equal to that which brings about the saturation of the two media. The magnetic field lines are closed through the structure indicated at 12. The conductor 10 is connected at its ends along Oy with two connectors (not shown) by which the phase shifter can be interconnected. Conductive walls (not shown) complete the casing made of the external conductors 6 and 7.

In the following figures, the magnets, the magnetic structure and the external conductors have been omitted for the sake of simplicity. These elements are identical to those illustrated in FIG. 2. The dimensions are indicated in the figures.

Figure 3:
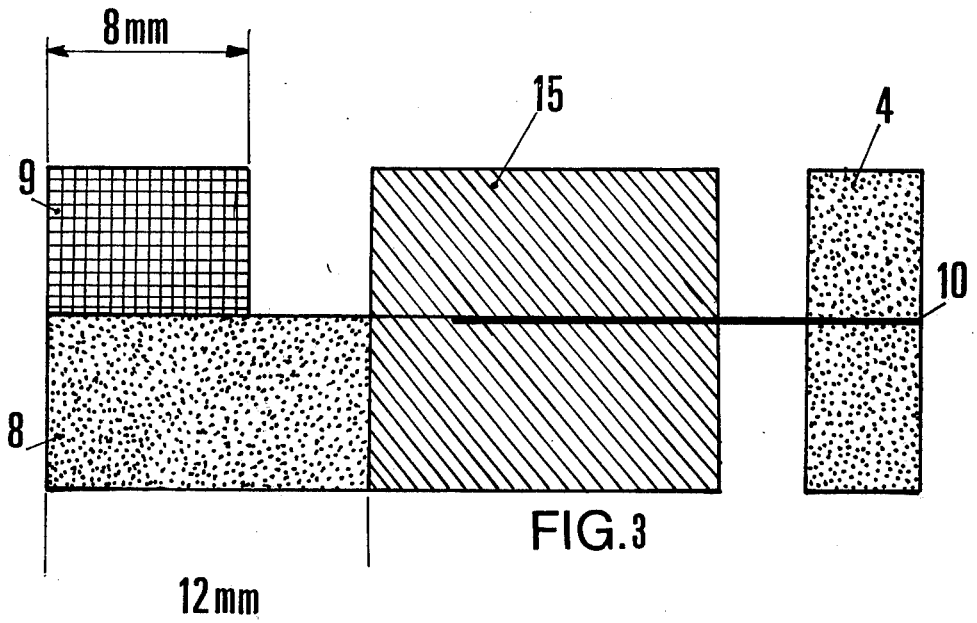
FIGS. 3 and 4 illustrate a very simplified form of phase shifter according to the invention and its characteristic.

FIG. 3 illustrates a simplified phase shifter structure in which the slabs 1 and 2 are made of a single material represented as slab 15. The first dielectric material 3 is air ($\epsilon_3=1$). The second has a permittivity $\epsilon_4=4$. The impedance 5 is infinite, that is to say, physically speaking, there is air between the slabs 4 and the casing.

Figure 4:
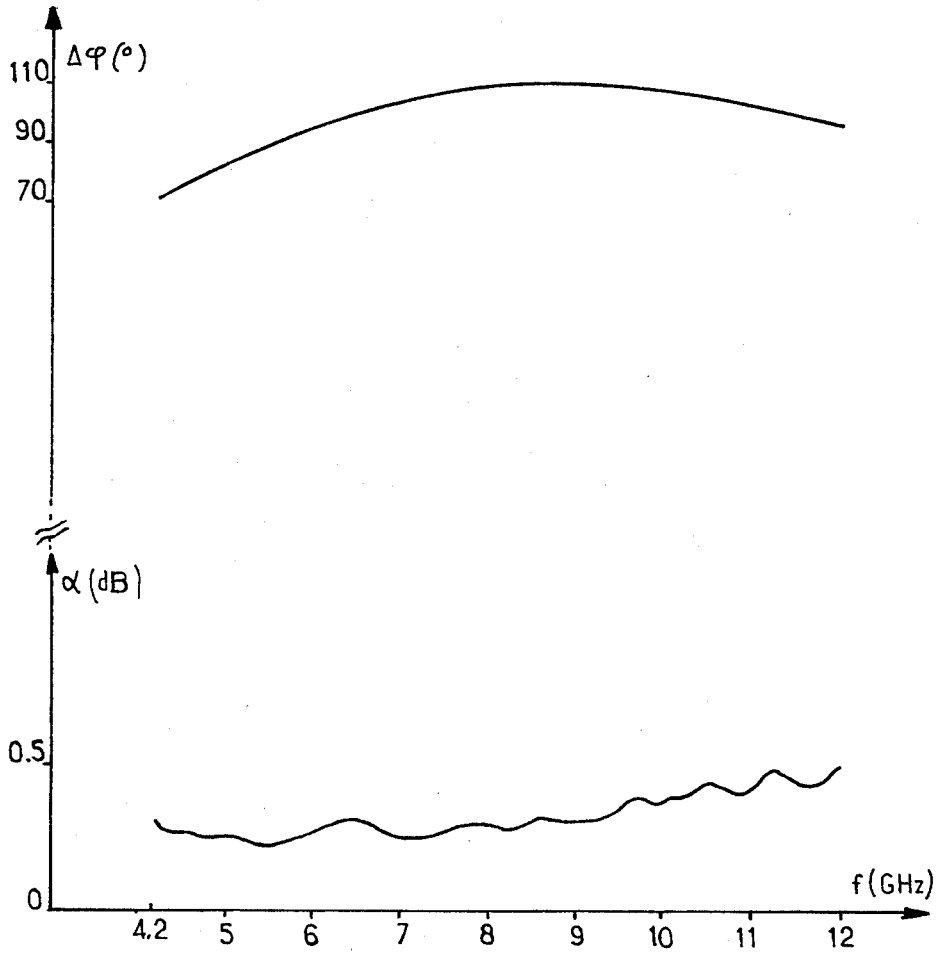

FIG. 4 is a characteristic curve of such a phase shifter for 90° operating in the 4.2–12 GHz band with an insertion loss lower than 0.5 dB in the band and effecting the desired phase shift to ±20° in the band. This simplified structure already has relatively good performance in regard to the insertion losses and from the viewpoint of bandwidth since it covers about one and a half octaves.

Figure 5:
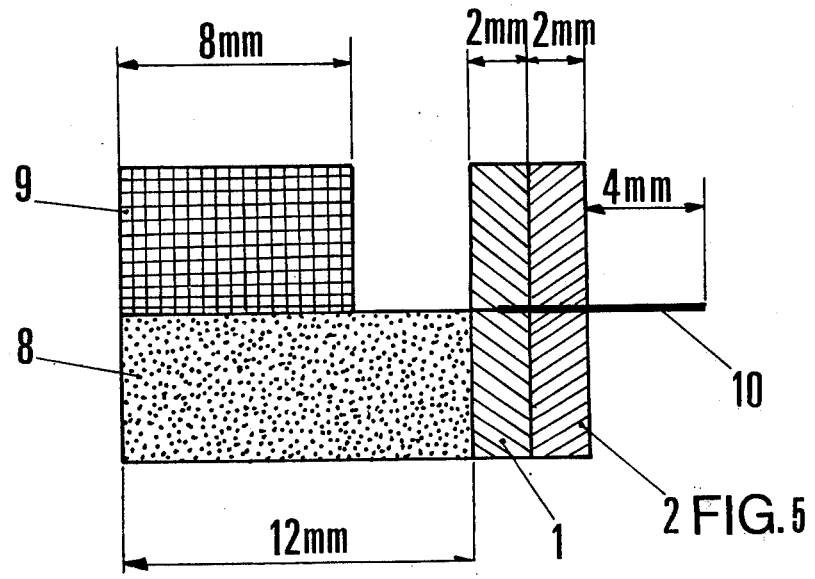
FIGS. 5 and 6 illustrate a third variant and its characteristic.
Figure 6:
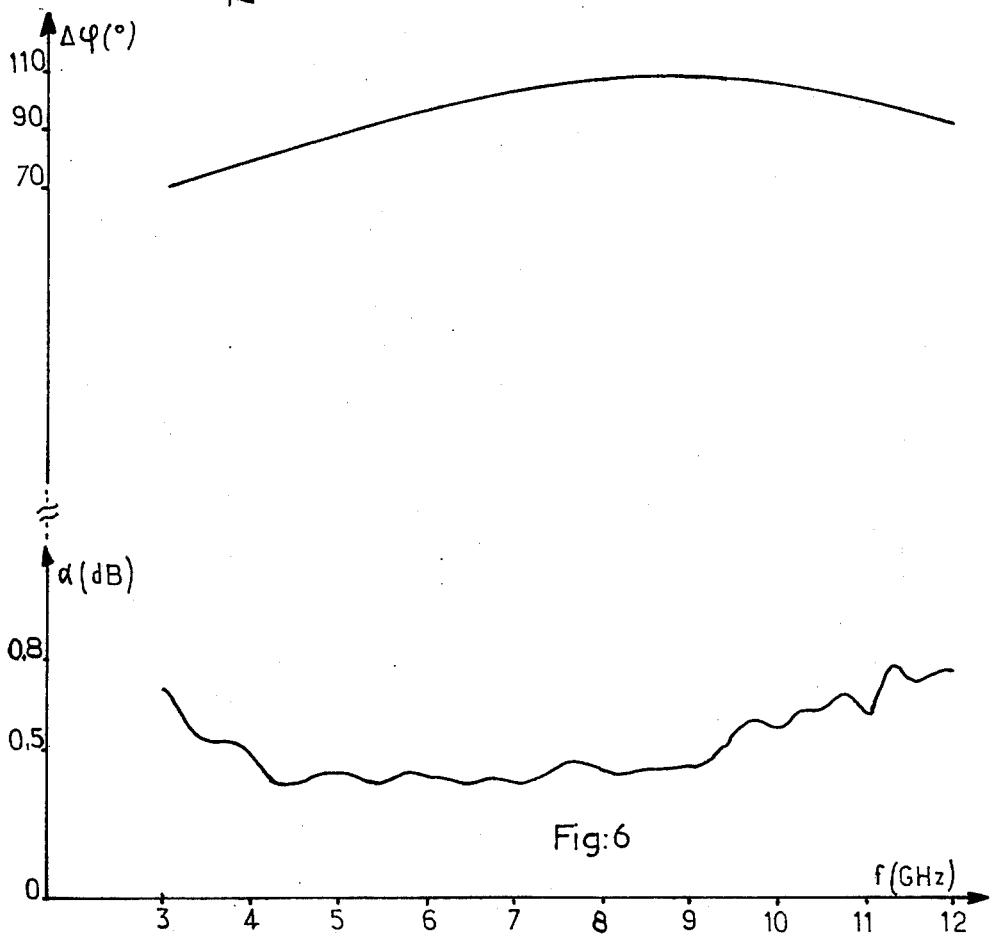

In the simplified structure just mentioned, a single gyromagnetic medium is used. The structure of FIG. 5 corresponds to a simplified variant in which use is made of two different materials for the wafers 1 and 2 respectively with the condition $4\pi M_{S1} < 4\pi M_{S2}$ where $M_{S1}$ and $M_{S2}$ are the saturation inductions of the two gyromagnetic media. The material having the lower induction is situated on that side of the structure where the magnetic wall is established. Such a structure, in which the dielectrics 3 and 4 are air, gives a characteristic curve as illustrated in FIG. 6 in the case of a 90° phase shifter. It will be seen that the band covered ranges from 3 to 12 GHz with an insertion loss lower than 0.8 dB, the phase shift being defined at ±20°. It will be seen that the use of two gyromagnetic wafers makes it possible to improve the performances of the device at the lower frequencies of the band as compared with the structure of FIG. 3.

Figure 7:
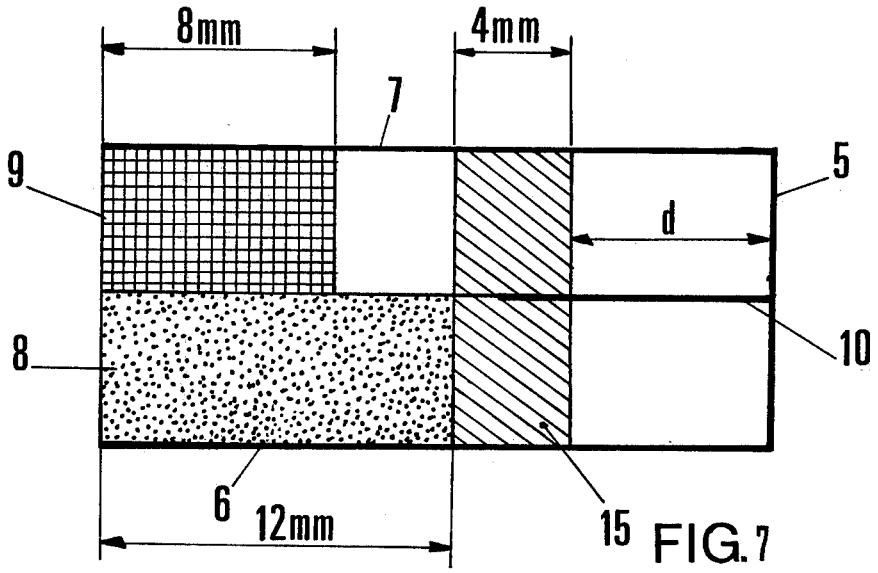
FIGS. 7 and 8 illustrate a fourth variant and its characteristic.
Figure 8:
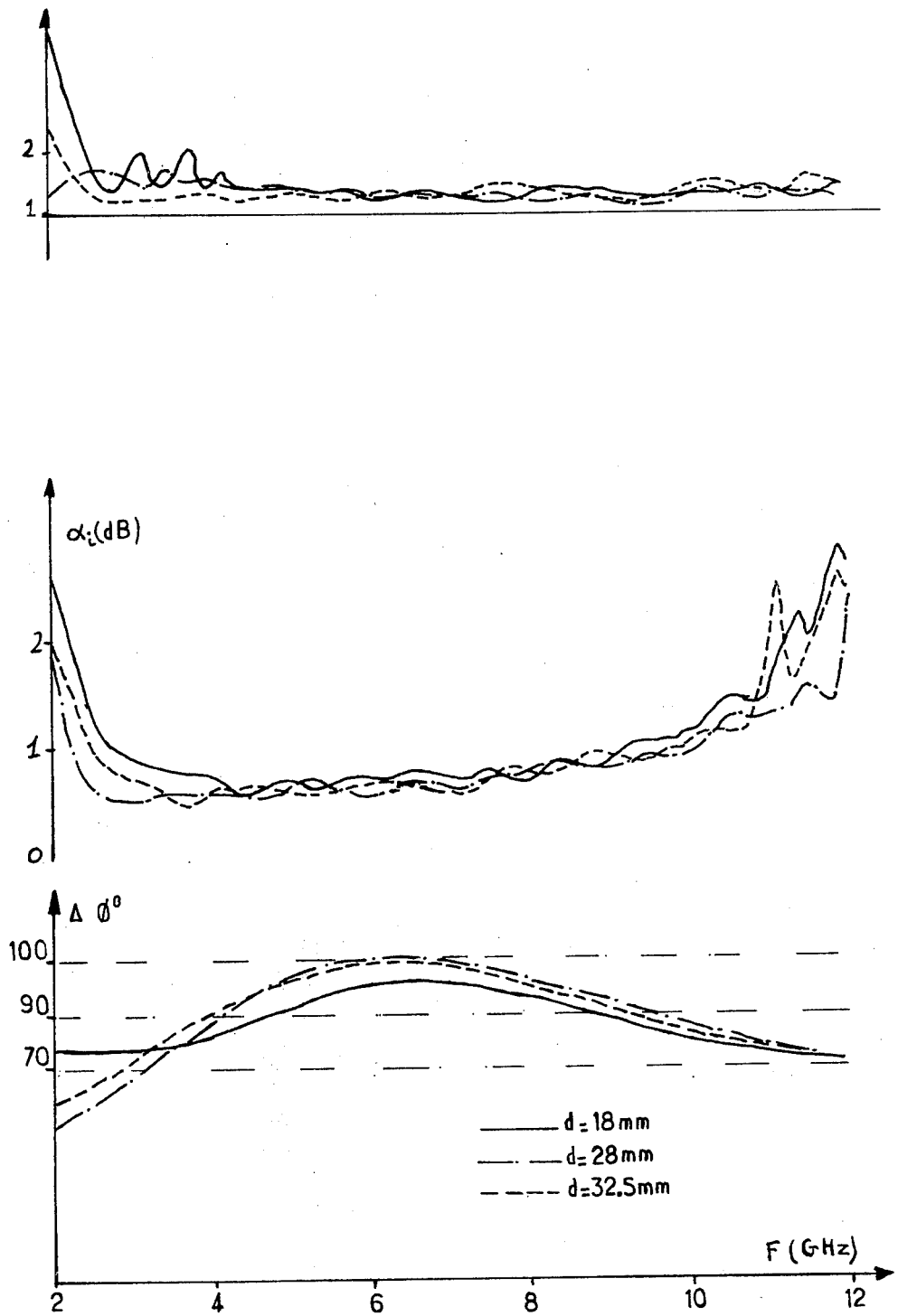

The influence of the impedance 5 is made evident in the simplified structure of FIG. 7, of which the characteristic curves are shown in FIG. 8. This structure comprises essentially a gyromagnetic material 15, dielectrics 3 and 4 consisting of air and an impedance 5 consisting of a short-circuit set up between the external conductors 6 and 7 of the strip structure and the central conductor plane 10. It will be seen that the use of a short-circuit improves the characteristic curves in the lower part of the frequency range, since the device thus formed covers the range from 2 to 12 GHz with an insertion loss lower than 1.2 dB and above all that this short-circuit brings about better stability of the phase shift which is ±12° at 90°.

Experience has shown that, as indicated by the curves of FIG. 8 which represents from the bottom upwards the phase shift, the insertion loss and the standing wave ratio in the band, the position of the short-circuit (distance d in the figure) influences the characteristics and specially at the lower end of the bandwidth. Experience has also shown that the minimum value of d is 18 mm for a structure of the type illustrated in the range 2–12 GHz. When d increases, the stability of the phase shift decreases and the standing wave ratio also.

Figure 9:
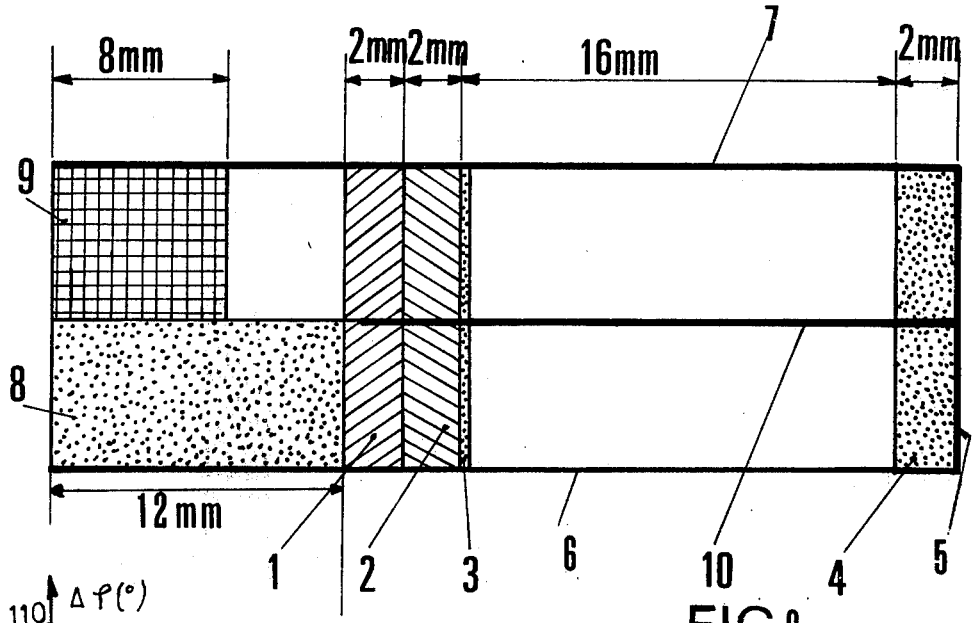
FIGS. 9 and 10 illustrate a variant and its characteristic, wherein solid dielectrics are placed between the ferrite and the electrical short-circuit.
Figure 10:
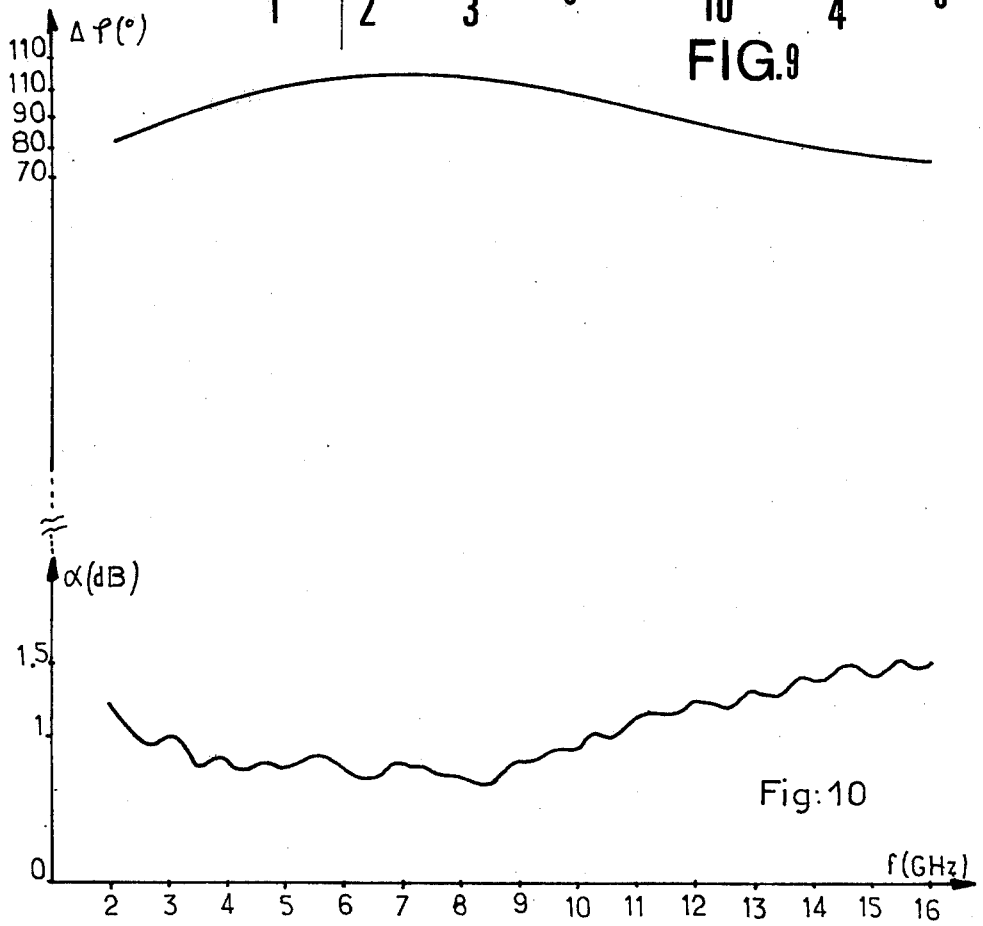

FIG. 9 corresponds to a complete structure of the type illustrated in FIG. 2, wherein a volume of air is left between the dielectric 3 and the dielectric 4 and wherein the impedance 5 is a short-circuit as in the previous embodiment. The characteristics of the structure are illustrated in FIG. 10 for a 90° phase shifter. The bandwidth covered, from 2 to 16 GHz (3 octaves), with an insertion loss lower than 1.5 dB, is higher than that of the simplified structures described in the foregoing. The phase shift remains within the interval of $$90^\circ \left\{ \begin{matrix} +20^\circ \\ -10^\circ \end{matrix} \right.$$

throughout the operating bandwidth. The frequency band is increased as compared with the foregoing variants. The stability of the phase shift is greater than that of the embodiments illustrated in FIGS. 3 and 5 and lower than that of the embodiment of FIG. 7.

Figure 11:
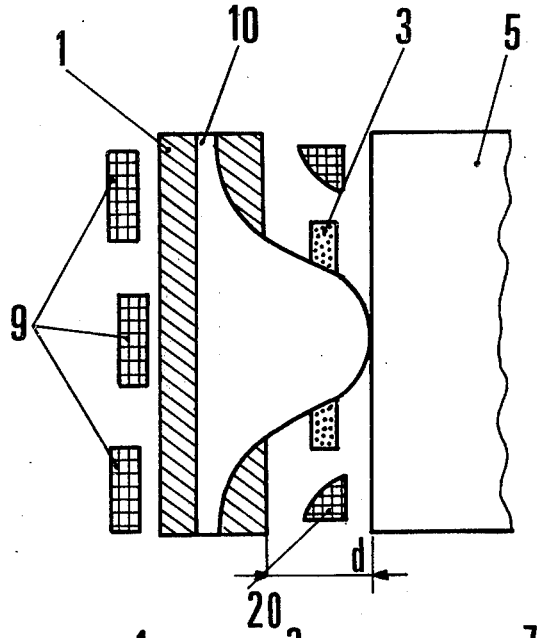
FIGS. 11 and 12 illustrate a preferred variant of the invention.
Figure 12:
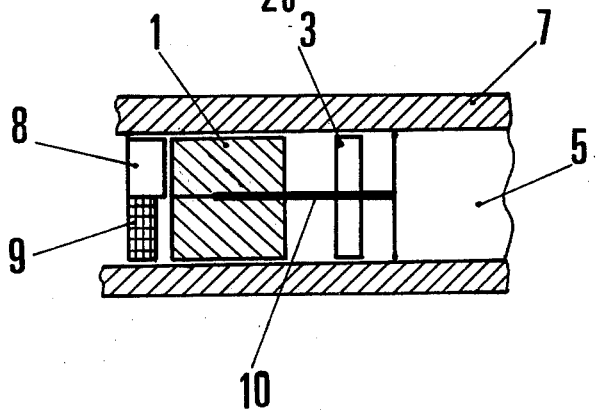
Figure 13:
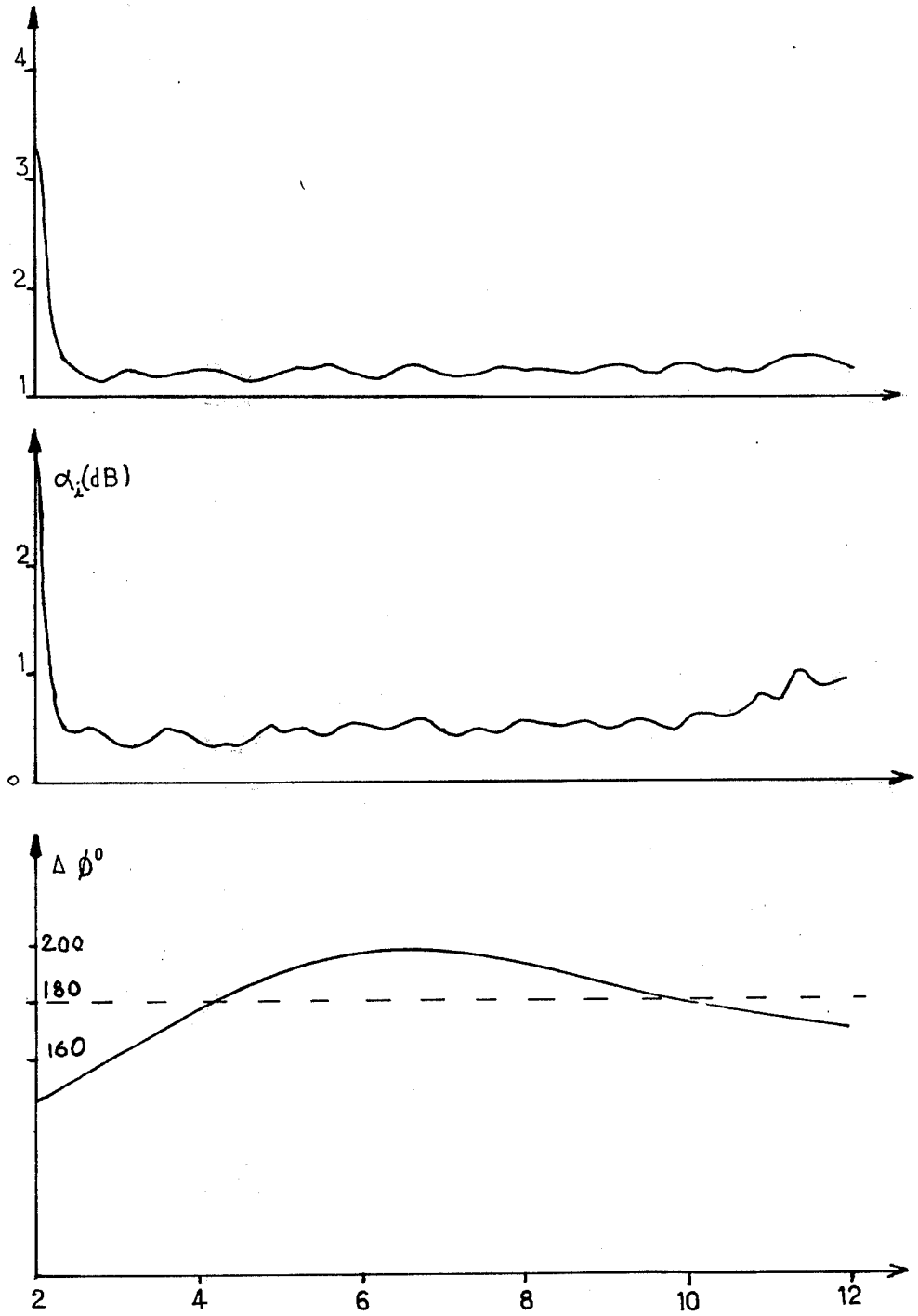
FIG. 13 illustrates the characteristics of the preferred variant.

FIGS. 11, 12 and 13 illustrate a preferred variant of the invention which combines the advantage of a relatively simple structure with advantageous characteristics (cf. FIG. 13). It is to be understood that any one of the foregoing variants may be more suitable depending upon the desired performances.

FIG. 11 is a view from above of the construction, it being assumed that the elements located above the central conductor 10 (plane XOY of FIG. 1) have been removed.

FIG. 12 is a sectional view taken along a plane perpendicular to the direction of propagation OY (plane ZOX of FIG. 1). As will be apparent, the propagation is guided by the slabs 1 made of a gyromagnetic material having a relative permittivity of 14.7 and a saturation induction $4\pi Ms = 1000$ gauss. Three loads 9 are disposed on the magnetic wall side at equal intervals along the structure (total length 80 mm; the dimension of the loads in the direction OY is 15 mm). The two extreme loads are at 4 mm from the edge of the slab 1 and the central load at 2 mm. The thin dielectric bar 3 (thickness 0.4 mm) is made of a material having a permittivity equal to 38. As will be apparent, localized loads 20 are disposed in the neighbourhood of the ends of the bar 3 to absorb the energy propagated in a "casing mode" defined by the dimensions of the guide formed by the external conductors and the other walls of the casing.

A short-circuit 5 is established between the two external conductors and the central conductor 10. The distance d between the right hand edge of the slab 1 and the short-circuit plane is about 20 mm. It will be observed that this distance is close to a submultiple of the wavelength in air at the lower frequency of the operating band, i.e. 2–12 GHz. The characteristics of this phase shifter are shown in FIG. 13. They are good in a band of 2.5 octaves.

What we claim is:

1. A stripline edge mode microwave phase shifter having a band width greater than two octaves comprising a central conductor, two external conductors parallel to the central conductor and two gyromagnetic slabs located one on each side of said central conductor so that a first edge of said slabs protrudes from said central conductor, two identical composite propagation media one on each side of said central conductor and located along a second edge of said slabs consisting of high permittivity dielectric slabs and a lump impedance and two different propagation media located along said first edge of said gyromagnetic slabs, the first of said media being a dielectric slab the permittivity of which is equal to that of the gyromagnetic medium and the second of which being lump discrete loads located by the side of said gyromagnetic slab along the direction of propagation, means for establishing a magnetizing field higher than the saturation field within said gyromagnetic slabs, means closing said magnetizing field, and means affording electrical connection to said central conductor at each end thereof along the direction of propagation.

2. A stripline microwave phase shifter according to claim 1 in which said lump impedance is a short circuit located at a distance from said second edge of said gyromagnetic slabs related to the minimum frequency of the operating frequency band.

3. A stripline microwave phase shifter according to claim 1 in which two gyromagnetic slabs are located side by side on each side of the central conductor, the saturation field of the gyromagnetic slab protruding from said conductor being lower than the saturation field of the other gyromagnetic slab.

4. A stripline microwave phase shifter according to claim 1 in which said high permittivity dielectric slabs located along said second edge of the gyromagnetic slabs is distant from the said first edge of said gyromagnetic slabs.

5. A stripline microwave shifter according to claim 1 having a surrounding protective casing in which further lump discrete loads are located at the ends of said high permittivity slabs to damp casing modes.

* * * * *